United States Patent [19]

Kawachi et al.

[11] Patent Number: 4,897,299

[45] Date of Patent: Jan. 30, 1990

[54] GRATING OF FIBER REINFORCED PLASTIC

[75] Inventors: Hideji Kawachi; Fumiyoshi Yamada; Toshiyasu Fukuya; Tetsuro Matsuo, all of Osaka, Japan

[73] Assignees: Kurimoto Plastics Co., Ltd., Osaka; Dainipponink & Chemicals, Inc., Tokyo, both of Japan

[21] Appl. No.: 226,314

[22] Filed: Jul. 26, 1988

[51] Int. Cl.[4] ..... B32B 3/00

[52] U.S. Cl. ..... 428/131; 428/139; 57/169.1; 57/177; 57/664; 57/666; 57/667; 57/668; 57/669

[58] Field of Search ..... 428/131, 134; 52/177, 52/664, 666, 667, 668, 669, 169

[56] References Cited

U.S. PATENT DOCUMENTS

| | | | |
|---|---|---|---|
| 4,028,460 | 6/1977 | Meyer | 52/660 |
| 4,276,337 | 1/1981 | Coonrod | 428/134 |
| 4,382,056 | 5/1983 | Coonrod | 156/169 |
| 4,522,009 | 6/1985 | Fingerson | 52/667 |
| 4,727,704 | 3/1988 | Carlton | 52/177 |
| 4,761,930 | 8/1988 | Tepera | 52/669 |

FOREIGN PATENT DOCUMENTS 23736 7/1985 Japan .

*Primary Examiner*—Jose G. Dees
*Assistant Examiner*—P. J. Ryan
*Attorney, Agent, or Firm*—Jones, Tullar & Cooper

[57] ABSTRACT

A grating of fiber reinforced plastic comprising a plurality of main beams of substantially I-shape in section made of fiber reinforced plastic and arranged in parallel to one another, and grid members also made of fiber reinforced plastic and engaged with the plurality of main beams to be integrally fixed to one another. By such a construction, there is produced an a cooperation between the high strength of the main beams and the load transmission performance of the grid members resulting in higher strength than conventional gratings of the same material. Individual components of the grating are suited for standardization and mass production, and besides gratings of various length and width are achieved by variation in the combination of the components.

4 Claims, 3 Drawing Sheets

GRATING OF FIBER REINFORCED PLASTIC

BACKGROUND OF THE INVENTION

1. Field of the Invention

The present invention relates to a grating to be used as a floor face in a tunnel, a corrosion resistant floor face, a floor board in a sewage treatment plant, walking passaage and the like.

2. Prior Art

Gratings have been conventionally manufactured of steel, but recently in cooperation with the development of glass fiber reinforced plastic (hereinafter referred to as "FRP") whose light weight and corrosion resistance properties are very advantageous in view of practical use, gratings of FRP are now widely used.

It is well known that gratings mainly composed of FRP are solidly formed by press working, otherwise are formed by assembling FRP components prepared by pultrusion with auxiliary members in such a manner as to have a specified distance between one component and the other.

FIG. 5 shows a grille grating which is solidly formed by press working with a metal pattern.

FIG. 6 shows an example of the aforementioned assembled grating, in which I-shaped drawn components 1a are one by one fitted laterally into insertion grooves provided in a spacer 5 to be laid in parallel, thus being assembled into a grid in appearance.

In the aforementioned conventional FRP gratings of the above construction, there exist several problems to be solved as follows:

(1) In the grating solidly formed by press working, the size of the grating is restricted, and it is impossible to manufacture a grating exceeding certain dimensions. Moreover, considering the property of the material, sufficient strength is not achieved when exceeding a certain size, and the grating manufactured by such a method is not recommended to put it in practical use.

(2) On the other hand, the components themselves prepared by drawing have a strength to a certain extent, but the formation of the grating by assembly is not economical because of the heavy weight of the components arranged with certain distances. Moreover, from the viewpoint of an assembled structure, the function of transmitting a load directly from one component to an adjacent one is insufficient, resulting in a concentration load limit at a rather low level.

SUMMARY OF THE INVENTION

The present invention was made to solve the above problems and has as an object of providing an improved grating which is not dimensionally restricted and in which there is substantially no disadvatage in view of load transmission performance.

In order to accomplish the foregoing object, a grating of FRP according to the invention comprises a plurality of main beams of substantially I-shape in section which are made of FRP and arranged in parallel to one another, and grid members which are also made of FRP and are engaged with the plurality of main beams to be integrally fixed thereto.

It is also preferably that an end face portion of each grid member is in contact with two flanges of each main beam of substantially I-shape in section at three faces of the flanges, i.e., back faces and side face in the middle part.

It is further preferable that the upper face of the flanges of the main beams and the upper face of the grid members are in substantially the same level forming a common surface when the main beams and grid members are fixed integrally to one another.

It is still further preferably that either the longitudinal rails or lateral rails forming each grid member are vertically provided with slits with a certain distance so that the rails without slits are vertically mated with the rails with slits at such slits to be assembled.

In the grating according to the construction of the invention, it is possible to combine freely any number of main beams of free length with any number of grid members of rather small size and, as a result, a grating of free dimensions including length and width can be assembled. Furthermore, since the load transmission performance between the main beams and the grid members is improved irrespective of their dimensions, the grating according to the invention have a high proof stress which is very advantageous in view of strength and durability. As for the grid members themselves, it may be said that a material of lower quality than the conventional gratings in the art can be used, so far as they have a strength sufficient for performing the function of transmitting load to the main beams.

In addition to the above mentioned varieties of advantages, the individual components such as main beam, grid member are easily standardized, which means that the invention is suited for mass production.

Other objects and features of the invention will become apparent in the course of the following description with the accompanying drawings.

BRIEF DESCRIPTION OF THE DRAWINGS

In the drawings forming a part of the present application, and in which like parts are designated with like reference numerals.

DESCRIPTION OF THE PREFERRED EMBODIMENT

Figure 1:
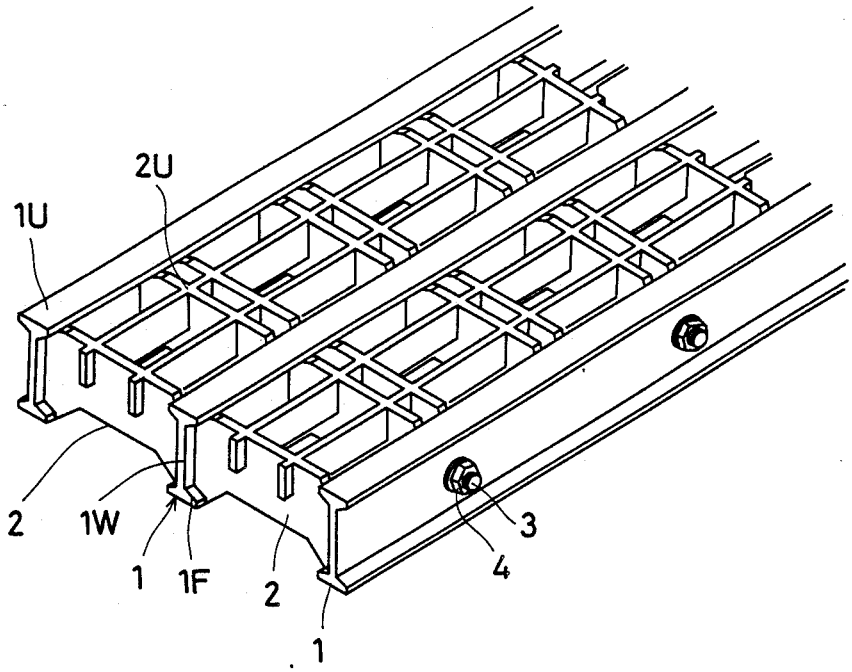
FIG. 1 is a perspective view illustrating an embodiment according to the present invention.

FIG. 1 is a perspective view illustrating one of the most preferred embodiment of the present invention. In the drawing, the main beams 1 of substantially I-shape in section is made of FRP. The fiber reinforced plastic is preferably formed by drawing in practical use to attain high strength. The grid members 2 aare placed between parallel arranged main beams and fixedly engaged therewith. The grating members 2 are also made of FRP and preferably formed solidly by press working.

When engaging the main beams and the grid members and fixing them to each other, there is produced a function of interpolation between high strength of the main beams and the load transmission performance of the grid members.

It is most preferable that each beam engages with each grid member in contact with three faces, i.e., the back faces 1F of the upper and lower flanges of each main beam 1 and the side face (web) 1W in the middle part. As for the level on the upper side, it is preferable that the upper face 1U of the flange of each main beam 1 and the upper face 2U of each grid member 2 are in substantially the same level forming a common surface.

Figure 2:
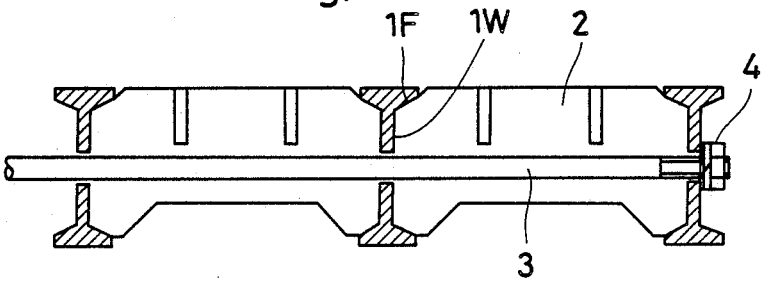
FIG. 2 is a sectional side view illustrating a coupled section of the embodiment of FIG. 1.

For integrally fixing the main beams and the grid members to each other, they can be simply screwed from both sides by a bolt 3 and a nut 4 as illustrated in FIG. 1 and FIG. 2 (sectional view of the fixed portion). The bolt and nut can be either of steel such as SUS304 or of FRP.

The foregoing embodiment insures a peculiar advantage of being suitable for a grating of long span because the strength of the main beams is increased as a result of formation by drawing. Further, since each grid member is engaged with each main beam being in contact with three faces, there is no sagging of the components, whereby load transmission from one component to the other is improved. Since the upper side of the main beams and that of the grid members are formed into a common surface as desribed above, full height of the grating can be reduced as compared with the conventional grating in which gratings are superposingly mounted on the main beams. Furthermore, for fixing the main beams to the grid members by screwing after the engagement, a perforation in the middle part of each main beam is quite sufficient, because the grid members assembled into a unit can be used as they are, eventually resulting in saving time and cost.

Figure 3A:
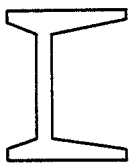
FIGS. 3 A and B are sectional views of another embodiment of the main beams.
Figure 3B:
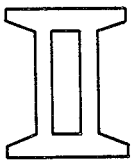

FIGS. 3A and B show modifications of the originally I-shaped main beam 1, one is transformed into a beam whose left and right are not symmetrical and the other is transformed into a double web shape. These modified main beams are preferably used in certain circumstances.

Figure 4A:
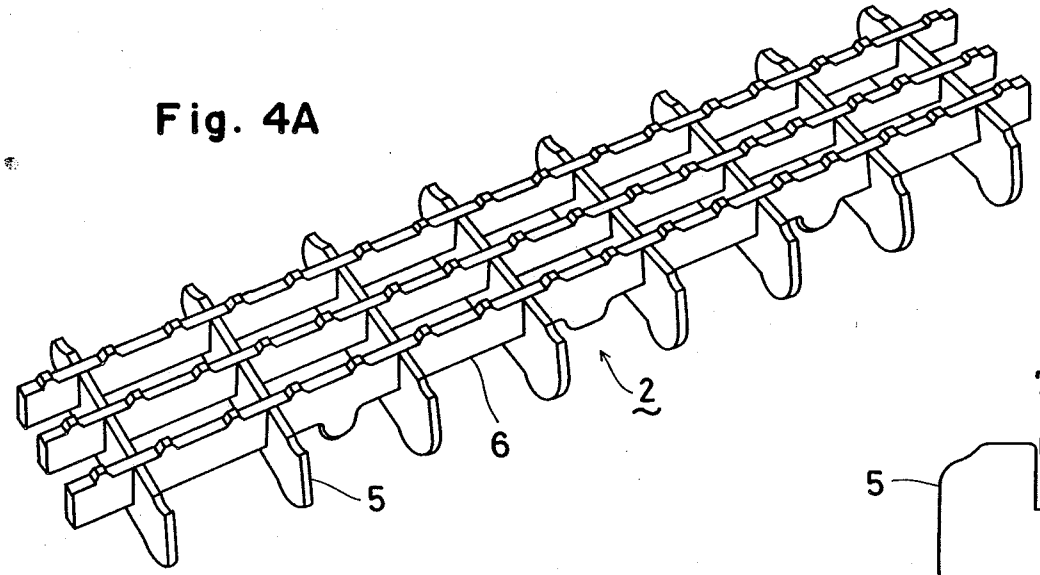
FIGS. 4 A, B and C show an embodiment of the grid members, and wherein A is a perspective view after assembly, B is a side view of a longitudinal rail and C is a front view of a lateral rail.
Figure 4B:
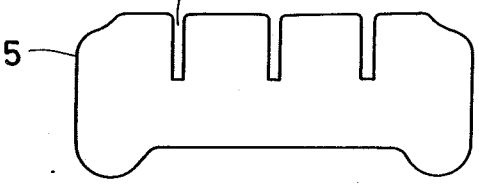
Figure 4C:
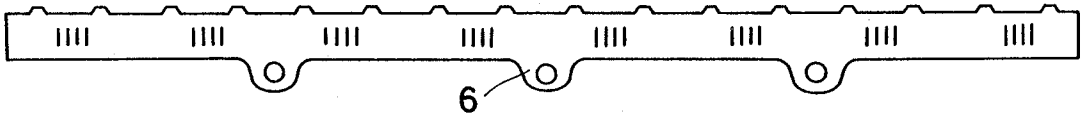
Figure 5:
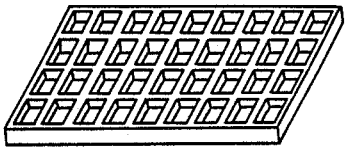
FIG. 5 illustrates a grille grating according to the prior art.
Figure 6:
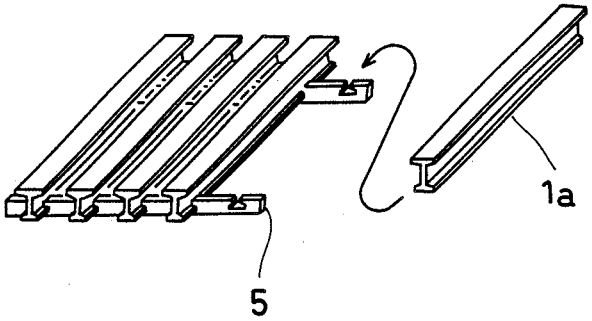
FIG. 6 illustrates an assembled grating with I-shaped components according to the prior art.

FIGS. 4 A, B and C show a further embodiment of the grid members 2, and in which A is a perspective view of a grating after being assembled, B is a side view of the longitudinal rail 5, and C is a front view of the lateral rail 6, respectively. It is to be noted that each longitudinal rail 5 is provided with the vertical slits 7 with a certain distance so that each lateral rail 6 is mated with each longitudinal rail at these slits. In this manner, a so-called weld problem in which reinforcing fibers are orientated is prevented by engaging the components formed separately by press working, whereby lowering in strength, which sometimes occurred in the solid molding, is eventually prevented.

What is claimed is:

1. A grating of fiber reinforced plastic, comprising: a plurality of main beams having an I-shaped cross section which are made of fiber reinforced plastic and arranged in parallel to one another, each main beam having an upper flange defining an upper face and two lower back faces, a lower flange defining a bottom face and two upper back faces and a center web defining two side faces, with a bottom, lower back face of the upper flange and the top upper back face of the lower flange being inclined at a gradual slope to a side face of the center web, and a plurality of grid members which are also made of fiber reinforced plastic, each having a top face and each contacting one of said plurality of main beams at corresponding lower back, upper back and side faces to be integrally fixed thereto, such that the top face of each grid member lies in the same plane as the top face of the main beams.

2. A grating according to claim 1, wherein the plurality of grid members each comprise a plurality of longitudinal rails and a plurality of lateral rails, and wherein either of said rails are provided with vertically extending, spaced apart, slits for receiving the other of said rails without slits.

3. A grating according to claim 1, further comprising a plurality of bolt menas for integrally fixing said main beams and said grid members to each other.

4. A grating according to claim 3, wherein said bolt means are made of fiber reinforced plastic.

* * * * *